United States Patent [19]

Orgera

[11] Patent Number: 4,581,065

[45] Date of Patent: Apr. 8, 1986

[54] PROCESS FOR THE METALLO-THERMIC REDUCTION OF BERYLLIUM OXIDE, BERYLLIUM MINERALS, AS WELL AS MIXTURES OF BERYLLIUM CONTAINING METAL OXIDES

[76] Inventor: Manfredi Orgera, via Pinin Pacot 24, I - 10131 Turin, Italy

[21] Appl. No.: 658,592

[22] Filed: Oct. 5, 1984

[30] Foreign Application Priority Data

Oct. 12, 1983 [IT] Italy ..... 68050 A/83

[51] Int. Cl.[4] ..... C22B 34/00; C22B 5/00

[52] U.S. Cl. ..... 75/84; 75/27

[58] Field of Search ..... 75/84, 10 R, 27; 149/37

[56] References Cited

U.S. PATENT DOCUMENTS

| | | | |
|---|---|---|---|
| 3,309,249 | 3/1967 | Allen | 149/37 |
| 3,347,721 | 10/1967 | Jago | 149/37 |
| 3,597,192 | 8/1971 | Wilhelm | 75/84 |
| 4,169,722 | 10/1979 | Fletcher | 75/84 |

*Primary Examiner*—John F. Terapane
*Assistant Examiner*—Anne Brookes
*Attorney, Agent, or Firm*—Michael J. Striker

[57] ABSTRACT

A process for the reduction of beryllium oxide in the pure state or contained in beryllium minerals or in mixtures of metal oxides by means of finely pulverized aluminium, magnesium or silicon, with an alumino-thermic type reaction which takes place at a temperature ranging between 2400° and 3200° C. with the addition of compounds rich in oxygen, such as the alkali metal nitrates.

7 Claims, No Drawings

PROCESS FOR THE METALLO-THERMIC REDUCTION OF BERYLLIUM OXIDE, BERYLLIUM MINERALS, AS WELL AS MIXTURES OF BERYLLIUM CONTAINING METAL OXIDES

BACKGROUND OF THE INVENTION

This invention relates to a process for the metallo-thermic reduction of beryllium oxide, beryllium minerals, as well as mixtures of beryllium containing metal oxides.

Metallic beryllium has been produced on an industrial scale already for many years chiefly in accordance with two processes known in the art.

The main difficulty in the production of beryllium on an industrial scale results because beryllium has an extremely high toxicity , chiefly when beryllium is in the form of easily volatile compounds, especially beryllium chloride $BeCl_2$ and beryllium fluoride $BeF_2$. On the other hand, with beryllium oxide it has been extremely difficult to directly reduce it to metal.

Therefore, the two known processes for the production of metallic beryllium are based on the reduction of beryllium chloride by electrolysis in a bath of molten salts or on the reduction of beryllium fluoride with metallic magnesium.

SUMMARY OF THE INVENTION

An object of this invention is to directly reduce beryllium oxide, both in the pure state and in materials containing it, such as beryllium minerals and also mixtures of certain metal oxides, thanks to the reaction of the beryllium oxide with suitable highly reactive metals and/or with mixtures of said metals in the form of extremely fine powder.

On the ground of the teachings of the German Pat. No. 410563, granted on Mar. 10, 1925, it may be recognized that, when a mixture of equivalent quantities of beryllium oxide with, for example, aluminum powder is made to ignite, the formation of metallic beryllium will in fact be observed; however, the exothermic development of this reaction is too low to produce the complete melting of the resulting mixture of metallic beryllium and aluminum oxide.

Accordingly, it is necessary to add to the reaction mixture, composed of beryllium oxide intimately mixed with the aluminum powder, compounds rich in oxygen, such as chlorates, perchlorates, peroxides and persulphates, for obtaining a complete melting of the reaction mass thanks to extremely high temperatures which are obtained because of the concomitant reaction between a determined excess of aluminum powder and the compounds rich in oxygen.

In the patent mentioned hereinabove there is also pointed out that through the complete combustion of a mixture of, for example, 10 Kg of beryllium oxide with 22.4 Kg of barium peroxide and 9.2 Kg of powdered aluminum in a crucible, the whole reaction takes place at once in a complete manner and the metallic beryllium is obtained simultaneously in the form of a regulus.

It has now been found that it is absolutely not necessary to use the expensive barium peroxide to obtain extremely high temperatures which are indispensable for the alumino-thermic reduction of beryllium oxide, and that the same object is attained also by the use of much less expensive compounds rich in oxygen, such as the nitrates of alkali metals.

It has also been found that in an embodiment of the present invention, in view of obtaining the metallic beryllium with satisfactory yields and easily separable from the slags, consisting mainly of aluminum oxide, it turned out to be advantageous to add to the mass of the above substances to be reacted even small quantities of the other already mentioned compounds rich in oxygen, such as chlorates, perchlorates, peroxides and persulphates.

Another advantage of using these compounds rich in oxygen in the process according to the present invention derives from the fact they have to be added in quantities much smaller with respect to those of the beryllium oxide to be reduced.

The objects of this invention are attained by a process for the reduction of beryllium oxide, which consists in subjecting the beryllium oxide or materials which contain beryllium oxide to a reduction with metals, of the type of the alumino-thermic reduction according to the Hans Goldschmidt method, the process according to the present invention being characterized in that said reduction takes place at a temperature between 2400° and 3200° C., with the addition of nitrates of alkali metals.

DETAILED DESCRIPTION OF THE INVENTION

In fact, to obtain extremely high temperatures which are absolutely necessary for the complete reduction of beryllium oxide, i.e. about 3000° C., it is indispensable to employ compounds rich in oxygen, which thanks to the highly exothermic reaction with the metal powder or the mixture of metal powders which is used for the reduction of beryllium oxide, provide a necessary thermal energy in an extremely short time.

As reducing metal elements there are used aluminum, magnesium and silicon, taken each alone or in mixture, alloys or intermetallic compounds thereof, in which the metal or the mixture of metals must be employed in the form of extremely fine powder.

As compounds rich in oxygen the nitrates of the alkali metals and, preferentially, sodium nitrate and potassium nitrate in amounts ranging from 25 to 75% by weight referred to the mass of the material to be reduced are employed, which, in an advantageous embodiment of the invention, may be mixed with chlorates, perchlorates, peroxides and persulphates in quantities from 5 to 30% by weight based on the mass of the material to be reduced.

The reduction of beryllium oxide in accordance with the process of this invention is carried out practically by mixing various reactants in a crucible of refractory material resistant to the high temperatures. It has been found that it is advantageous to carry out such reduction in a crucible of synthetic cordierite obtained by melting magnesium oxide with calcined kaolinite.

This material has a very low coefficient of expansion and therefore it is capable of withstanding extremely high variations fluctuations of temperature in very short time intervals.

The invention will now be described in more detail with reference to some examples of execution which are not to be considered as limiting as regards the subject of the invention.

EXAMPLE I

The following substances in the form of extremely fine powder which have to be reacted were intimately mixed:

100 g beryllium oxide (MERCK, technically pure)
70 g aluminum powder (Purity: min.95%)
30 g potassium nitrate (Purity: 99.5%).

This mixture was introduced into a thick wall crucible of synthetic cordierite resistant to high temperatures, and then the mass to be reacted was ignited by contacting its surface with a red-hot body, for example by iron rod whose tip has been made red-hot. After the ignition has taken place, the entire mass has completely burnt thereby developing an extremely intense heat (white heat).

After termination of the reaction, the molten mass was left to air-cool in the same reaction crucible.

After the cooling, a metallic regulus can easily be separated from the slag of aluminum oxide.

The raw beryllium thus obtained, which may still contain impurities (chiefly aluminum oxide), may be further purified in a manner known per se.

EXAMPLE II

The following substances to be reacted in an extremely pure state were intimately mixed, and thereafter the reaction was initiated as has been explained in Example I:

100 g beryllium oxide (Purity: 99.97%)
85 g aluminum powder (99.5%)
45 g $KNO_3$ (99.5%)
20 g $KClO_3$ (99.5%)

The metallic beryllium which has been obtained by this reaction has a considerable purity degree. Also the yield is very satisfactory.

EXAMPLE III

The following substances to be reacted in an extremely pure state were intimately mixed:

100 g beryllium oxide (Purity 98%)
60 g aluminum +30 g $Mg_2Si$ magnesium silicide
50 g $KNO_3$
20 g $BaO_2$ The reaction between the above mixed compounds has been then initiated as in the preceding Examples.

EXAMPLE IV

The following substances to be reacted in an extremely pure state were intimately mixed:

100 g beryl ($3BeO.Al_2O_3.6SiO_2$) pulverized (10–13% BeO)
70 g aluminum powder (at least 90%)
30 g potassium nitrate (99.5%)

Then a reaction similarly to any of the above described Examples is initiated.

Also in this case a complete reduction of the oxides contained in a mineral takes place, to thereby obtain an alloy of silicon, aluminum, beryllium and iron, from which beryllium may be extracted and purified by any chemical treatment known in the art of beryllium production.

I claim:

1. A method of conducting a metallo-thermic reduction of a material selected from the group consisting of beryllium oxide, beryllium minerals, and mixtures of beryllium oxide with other metal oxides, comprising the steps of intimately mixing said material alone or in combination, with a powder of a metal selected from the group consisting of aluminum, magnesium and silicon taken alone or in mixtures, alloys or intermetallic compounds thereof, and with an alkali metal nitrate selected from the group consisting of potassium nitrate and sodium nitrate, whereby heat temperatures of a reaction of a mixture are increased to about 2400°–3200° C., at which temperatures the beryllium oxide is completely reduced to beryllium metal, wherein said powder of said metal does not exceed 90% by weight of the material to be reduced and said alkali metal nitrate does not exceed 50% by weight of the material to be reduced; and thereafter allowing the reaction mixture to cool and separating the resultant beryllium metal or beryllium alloy from a slag.

2. A method of conducting a metallo-thermic reduction as claimed in claim 1, wherein the reduction is carried out in a temperature range between 2800° and 3000° C.

3. A method of conducting a metallo-thermic reduction as claimed in claim 1, wherein said alkali metal nitrate is added in an amount from 25 to 50% by weight of the material to be reduced.

4. A method of conducting a metallo-thermic reduction as claimed in claim 3, wherein said alkali metal nitrate is added in an amount from 30 to 45% by weight of the material to be reduced.

5. A method of conducting a metallo-thermic reduction as claimed in claim 1, wherein the reduction is carried out with the addition of compounds rich in oxygen selected from the group consisting of chlorates, perchlorates, peroxides and persulphates of alkali or alkaline earth metals, and ammonium chlorates or perchlorates, taken each alone or in mixtures thereof.

6. A method of conducting a metallo-thermic reduction as claimed in claim 5, wherein said compounds rich in oxygen are added in amounts from 5 to 30% by weight based on the mass of the material to be reduced.

7. A method of conducting a metallo-thermic reduction as claimed in claim 1, wherein the reduction reaction is carried out in a synthetic cordierite crucible.

* * * * *